US007544877B2

(12) United States Patent
Saito

(10) Patent No.: US 7,544,877 B2
(45) Date of Patent: Jun. 9, 2009

(54) MUSICAL KEYBOARD INSTRUMENT

(75) Inventor: Daisuke Saito, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 432 days.

(21) Appl. No.: 11/375,315

(22) Filed: Mar. 13, 2006

(65) Prior Publication Data

US 2007/0012162 A1 Jan. 18, 2007

(30) Foreign Application Priority Data

Mar. 14, 2005 (JP) ..... 2005-071769

(51) Int. Cl.
*G10G 3/00* (2006.01)

(52) U.S. Cl. ..... 84/453

(58) Field of Classification Search ..... 84/423 R, 84/453, 433–436, 174, 184, 185, 186.1, 190, 84/243

See application file for complete search history.

(56) References Cited

U.S. PATENT DOCUMENTS 5,465,644 A * 11/1995 Shimoda et al. ..... 84/423 R
7,365,259 B2 * 4/2008 Nishida ..... 84/423 R

FOREIGN PATENT DOCUMENTS

| | | | |
|---|---|---|---|
| JP | 5241567 | 9/1993 | |
| JP | 405307382 A * | 11/1993 | ..... 84/423 R |
| JP | 2003/122362 | 4/2003 | |
| JP | 2003/248480 | 9/2003 | |
| JP | 2003/345358 | 12/2003 | |

* cited by examiner

*Primary Examiner*—Kimberly R Lockett
(74) *Attorney, Agent, or Firm*—Morrison & Foerster LLP

(57) ABSTRACT

A musical keyboard instrument which not only allows a music stand to be erected in a desired position in the transverse direction on a panel section, but also ensures easiness of viewing a written musical score of a music book even when the music stand is erected in the vicinity of the left or right end of the panel section. A keyboard section includes a plurality of keys arranged in a front part thereof. A panel section is provided at a location rearward of the keyboard section. An arcuate groove part is formed in the panel section, for engagement with leg parts of a music stand. The arcuate groove part is formed such that the leg parts of the music stand can be engaged therewith in a desired position in the transverse direction, and is curved in a rearwardly convex manner.

10 Claims, 9 Drawing Sheets

MUSICAL KEYBOARD INSTRUMENT

BACKGROUND OF THE INVENTION

1. Field of the Invention

The present invention relates to a musical keyboard instrument having a panel section on which a music rest for supporting a music sheet or a music book can be erected.

2. Description of the Related Art

Conventionally, a musical keyboard instrument is known which is configured such that a music stand or a music rack for supporting a music book during musical performance on a musical keyboard instrument, such as an electronic organ or an electronic piano, can be attached to a desired location in the transverse direction (in the direction of width of the instrument, i.e. in the left-right direction as viewed from the player) on a musical keyboard instrument body. For example, there has been proposed a musical keyboard instrument that has a protruded portion formed on a rear surface of a rear part of a panel with a music rack fitting groove formed therein such that the groove has a uniform width over its entire length, and a music rack retainer formed in the music rack fitting groove along the entire length of the music rack fitting groove, (see e.g. the publication of Japanese Patent No. 2570940). In this musical keyboard instrument, an insertion part formed as a lower end of a music rack is inserted or fitted into the music rack fitting groove and retained by the music rack retainer, whereby the music rack can be erected in a desired position.

However, a musical keyboard instrument of the above-mentioned type has a music rack fitting groove longitudinally extending in a straight line, and hence wherever a music rack is erected, the music rack faces forward. For this reason, when the music rack is erected in the vicinity of the left or right end of the music rack fitting groove, a music book is inevitably placed on the music rack in oblique relation to a player, which makes it difficult for the player to view a written musical score.

SUMMARY OF THE INVENTION

It is an object of the present invention to provide a musical keyboard instrument which not only allows a music stand to be erected in a desired position in the transverse direction on a panel section, but also ensures easiness of viewing a written musical score even when the music stand is erected in the vicinity of the left or right end of the panel section.

To attain the above object, in a first aspect of the present invention, there is provided a musical keyboard instrument comprising a keyboard section that includes a plurality of keys arranged in a front part thereof, a panel section that is provided at a location rearward of the keyboard section, and a panel-side engagement part that is formed on the panel section for engagement with a music stand-side engagement part of a music stand that supports a music score and has a leg part formed with the music stand-side engagement part, wherein the panel-side engagement part is formed such that the music stand-side engagement part of the music stand can be engaged with the panel-side engagement part in a desired position in a transverse direction, and wherein the panel-side engagement part is curved in a rearwardly convex manner, and the music stand-side engagement part is engaged with the panel-side engagement part, whereby the music stand can be erected in a desired position in the transverse direction on the panel section.

With this arrangement of the first aspect of the present invention, the panel-side engagement part engageable with the music stand-side engagement part extends curved to be convex rearward, so that it is possible to erect the music stand in a desired position in the transverse direction on the panel section, and ensure easiness of viewing music even when the music stand is erected in the vicinity of the left or right end of the panel section.

Preferably, the music stand-side engagement part of the music stand is protruded, and the panel-side engagement part on the panel section has a shape of a bottomed groove.

Preferably, the music stand-side engagement part of the music stand has a shape of a groove, and the panel-side engagement part on the panel section is protruded.

Preferably, the musical keyboard instrument comprises left and right sounding sections that are disposed in opposite left and right ends of the panel section, respectively, for sounding musical tones at least forward, and the panel-side engagement part causes a left or right end of the music stand to be positioned at a location where the left or right end of the music stand does not substantially obstruct the left or right sounding section when the music stand is erected in a leftmost or rightmost position on the panel section within a range where the music stand can be erected.

Preferably, the music stand-side engagement part of the music stand has a protruded shape, and the panel-side engagement part on the panel section has a shape of a groove, and an engagement guide part guides the music stand-side engagement part into engagement with the panel-side engagement part when the music stand is erected on the panel section.

Preferably, the music stand-side engagement part of the music stand has a protruded shape, and the panel-side engagement part on the panel section has a shape of a groove, and a sloping part is provided at a location forward of the panel-side engagement part such that the sloping part slopes down rearward to be continuous with the panel-side engagement part.

To attain the above object, in a second aspect of the present invention, there is provided a musical keyboard instrument comprising a keyboard section that includes a plurality of keys arranged in a front part thereof, a panel section that is provided at a location rearward of the keyboard section, the panel section having a panel-side engagement part formed thereon, a music stand that supports a music score, the music stand having a leg part and a music stand-side engagement part that is formed on the leg part so as to be engageable with the panel-side engagement part in a desired position in a traverse direction on the panel section, wherein at least one of the panel-side engagement part and the music stand-side engagement part is curved in a rearwardly convex manner, and the music stand-side engagement part is engaged with the panel-side engagement part, whereby the music stand can be erected in a desired position in the transverse direction on the panel section.

With this arrangement of the second aspect of the present invention, at least one of the music stand-side engagement part and the panel-side engagement part engageable with each other extends curved to be convex rearward, so that it is possible to erect the music stand in a desired position in the transverse direction on the panel section, and ensure easiness of viewing music even when the music stand is erected in the vicinity of the left or right end of the panel section.

Preferably, the music stand-side engagement part of the music stand has a protruded shape, and the panel-side engagement part on the panel section has a shape of a bottomed groove.

Preferably, the music stand-side engagement part of the music stand has a shape of a groove, and the panel-side engagement part on the panel section has a protruded shape.

Preferably, a plurality of the music stands are provided, a total of transverse widths thereof being equal to or smaller than a transverse width of the musical keyboard instrument, and the music stands can be simultaneously arranged side by side on the panel section in a manner transversely adjacent to each other.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing a preferred embodiment thereof.

Figure 1A:
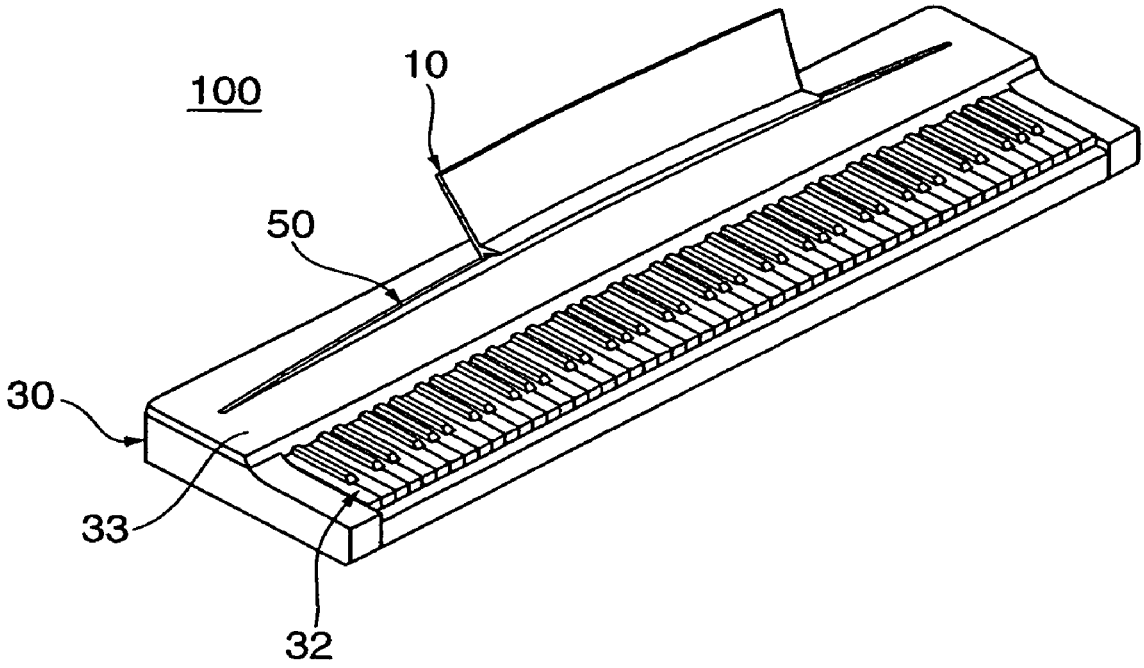
FIG. 1A is a schematic perspective view of a musical keyboard instrument according to an embodiment of the present invention.
Figure 1B:
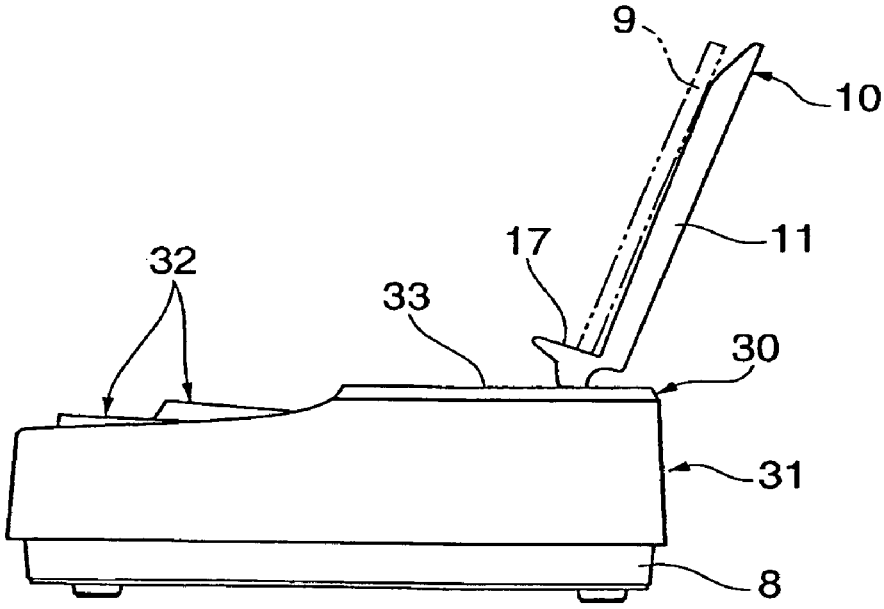
FIG. 1B is a right side view of the musical keyboard instrument.

FIG. 1A is a schematic perspective of a musical keyboard instrument according to an embodiment of the present invention. FIG. 1B is a right side view of the musical keyboard instrument.

As shown in FIGS. 1A and 1B, the musical keyboard instrument 100 is comprised of a keyboard instrument body 30, and a music stand 10 formed separately from the keyboard instrument body 30. FIGS. 1A and 1B show a state in which the music stand 10 is erected on the keyboard instrument body 30. In the following description, a side of the keyboard instrument body 30 toward a player will be referred to as "the front side", and the terms related to the "left" and "right" of the keyboard instrument body 30 will be used as having respective meanings defined with reference to the player.

In the keyboard instrument body 30, there are formed a keyboard section 32 comprised of a plurality of keys arranged in a front part, and a panel section 33 located rearward of the keyboard section 32. As shown in FIG. 1B, the keyboard instrument body 30 has an upper case 31, and a lower case 8 mounted on the upper case 31. As described in detail hereinafter, the panel section 33 is formed with a music stand erecting part 50, and the music stand 10 for holding the music book 9 can be erected (or mounted) on the music stand erecting part 50 and removed therefrom.

Figure 2A:
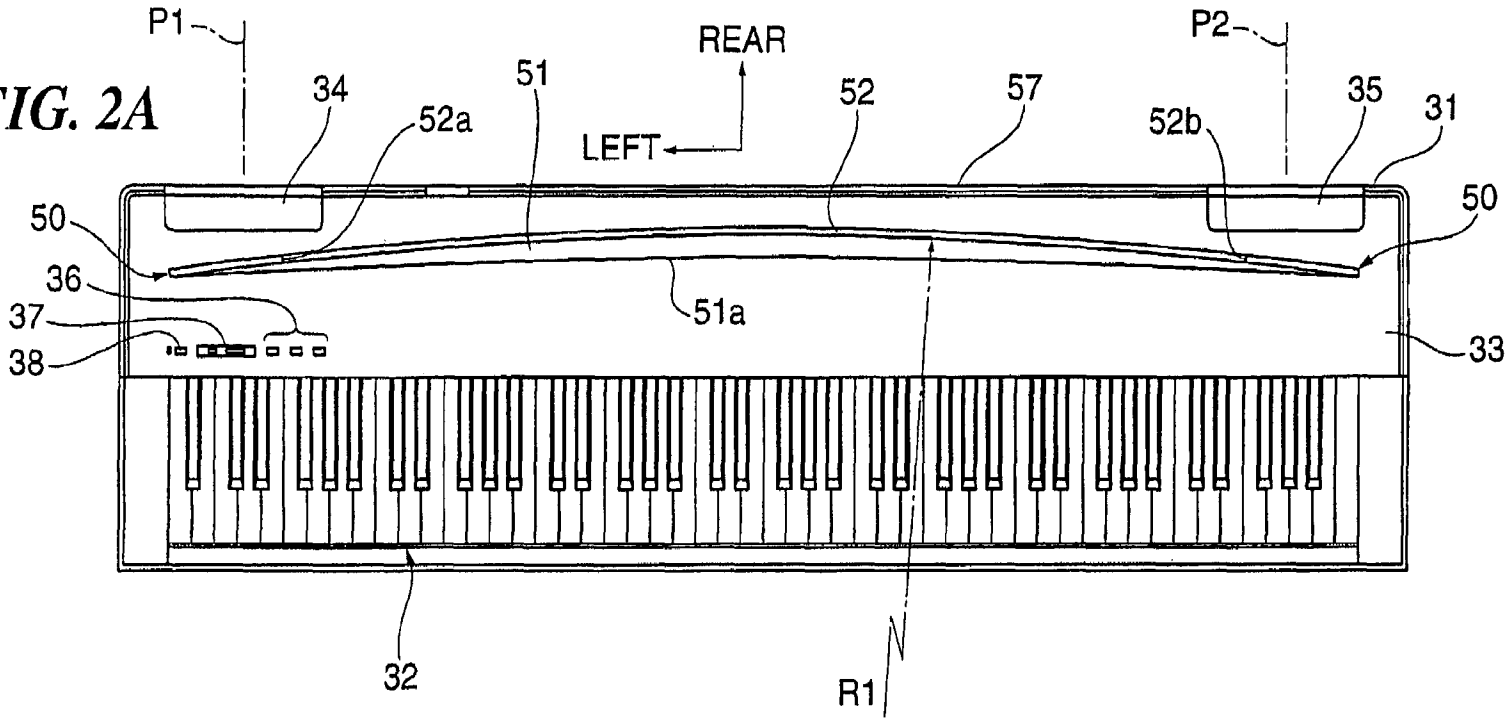
FIG. 2A is a plan view of the keyboard instrument body appearing in FIGS. 1A and 1B.
Figure 2B:
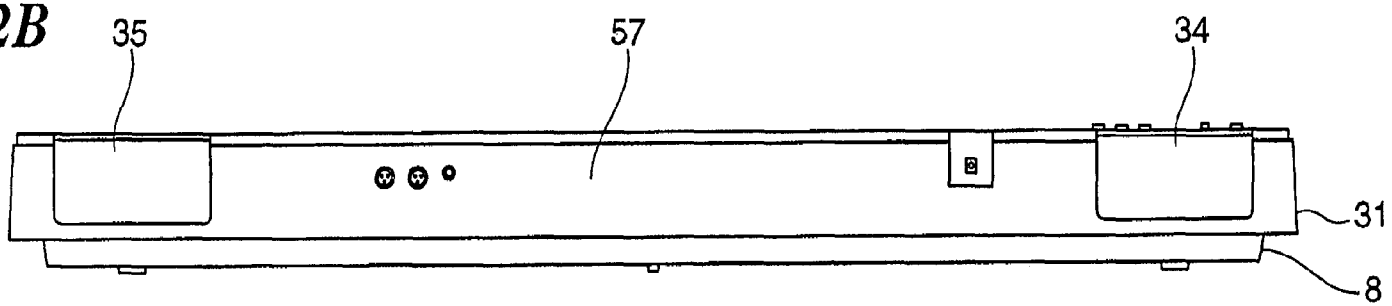
FIG. 2B is a rear view of the keyboard instrument body.

FIG. 2A is a plan view of the keyboard instrument body 30 appearing in FIGS. 1A and 1B, and FIG. 2B is a rear view of the same.

As shown in FIGS. 2A and 2B, in a left end of the panel section 33, there are arranged function switches 36, a master volume switch 37, and a power switch 38. Sounding sections 34 and 35 for sounding musical tones are formed in the respective left and right ends of the panel section 33 such that they extend from within the panel section 33 to a rear surface 57. Within the keyboard instrument body 30, there is provided a musical tone generator, not shown, and musical tones generated in response to key touch operations on the keyboard section 32 e.g. during musical performance are mainly sounded rearward, upward, and forward from the sounding sections 34 and 35. The sounding section 34 (35) is comprised, for example, of a speaker, not shown, mounted at the rear end of the keyboard instrument body 30 in a manner facing rearward, and a sound outlet porous cover or net, not shown. The sounding sections 34 and 35 have respective upper surfaces thereof formed generally flush with the panel section 33. Thus, musical tones are radiated not only rearward from the rear surface 57, but also upward and forward from the sound outlet porous covers.

Figure 3:
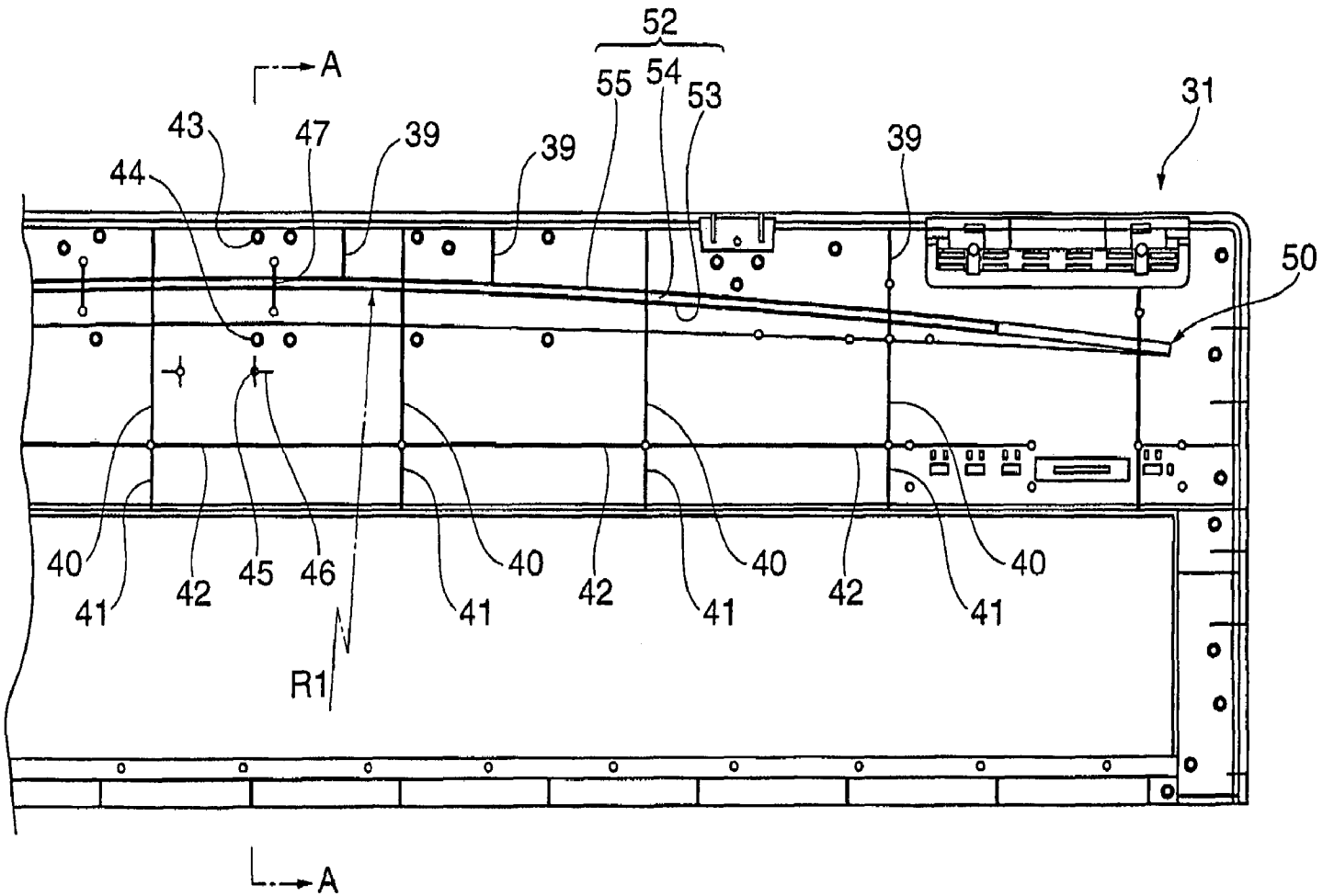
FIG. 3 is a back view of an upper case in FIG. 1B.
Figure 4:
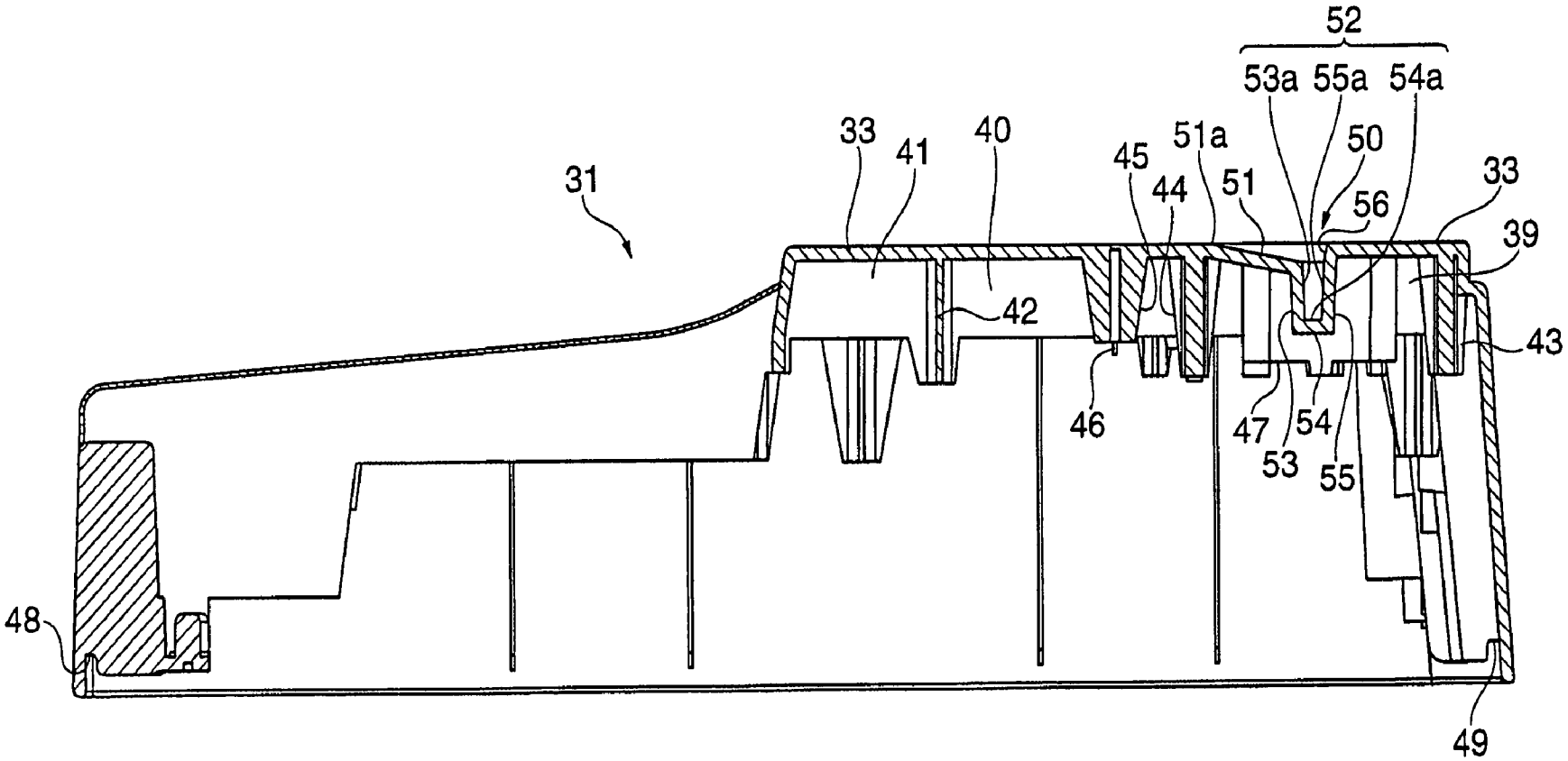
FIG. 4 is a cross-sectional view taken on line A-A of FIG. 3.

FIG. 3 is a rear view of the upper case 31 in FIG. B. FIG. 4 is a cross-sectional view taken on line A-A of FIG. 3.

As shown in FIG. 4, the upper case 31 has lower front and rear portions thereof formed with lower case mounting parts 48 and 49, respectively. The upper case 31 is fixedly coupled to the lower case 8 by screws, not shown, via the lower case mounting parts 48 and 49.

As shown in FIG. 2A, the music stand erecting part 50 is symmetrically formed on the panel section 33 in a manner extending over a length slightly shorter than the entire width of the keyboard instrument body 30. The music stand erecting part 50 is comprised of an arcuate groove part 52 and a sloping surface part 51 formed at a location immediately forward of the arcuate groove part 52 in a manner continuous therewith, and has an arcuate shape in plan view.

As shown in FIG. 4, the arcuate groove part 52 is formed by a rear surface 53*a* of a front wall 53, a bottom surface 54*a* as an upper surface of a bottom wall 54, and a front surface 55*a* of a rear wall 55 into a bottomed groove having a generally U shape in cross section. The rear surface 53*a* of the front wall 53 and the front surface 55*a* of the rear wall 55 are each formed as a tapered surface such that the arcuate groove part 52 is slightly expanded in width as it extends toward its top. The degree of the expansion is larger than a draft angle required for resin molding (e.g. three times as large as the draft angle). As shown in FIGS. 2A and 3, the front wall 53 and the rear wall 55 forming the arcuate groove part 52 are formed along a gentle curve having a radius R1 (of e.g. approximately 5000 mm, curvature=$1/5000$ (1/mm)) with a center located forward of the arcuate groove part 52 into an arcuate shape such that they are curved in a rearwardly convex manner. Therefore, the distance from the front end of the musical keyboard instrument 100 to the arcuate groove part 52 is longest at the center of the arcuate groove part 52 in the transverse direction (in the left-right direction, i.e. in the direction along the length) thereof, and becomes shorter as the arcuate groove part 52 extends toward the left or right end of the arcuate groove part 52.

Further, as shown in FIG. 4, the rear wall 55 has an upper portion thereof formed with a chamfered part 56 sloping rearward from the rear wall 55 in a manner continuous with the front surface 55*a* of the rear wall 55. The front surface 55*a* is connected to the panel section 33 via the chamfered part 56. On the other hand, the sloping surface part 51 is formed in a manner continuous with the top of the front wall 53, and therefore the rear surface 53*a* of the front wall 53 is connected to the panel section 33 via the sloping surface part 51. The sloping surface part 51 is a plane gently sloping from the panel section 33 toward the top of the front wall 53. The sloping surface part 51 has a front end 51*a* thereof extending linearly in the transverse direction as shown in FIG. 2A.

As shown in FIG. 2A, in the music stand erecting part 50, the sloping surface part 51 is arcuate in plan view and extends over the entire length of the music stand erecting part 50, while the arcuate groove part 52 has opposite left and right ends 52*a* and 52*b* located slightly inward of the left and right ends of the music stand erecting part 50 in the transverse direction.

As shown in FIGS. 3 and 4, in the upper case 31, a plurality of vertical ribs 39 formed in a manner continuous with the rear wall 55 extend rearward from the rear wall 55 to the rear part of the upper case 31. On the other hand, a plurality of vertical ribs 40 formed in a manner continuous with the front wall 53 extend forward from the front wall 53. A vertical rib 41 formed continuously with each of the vertical ribs 40 extends forward from the vertical rib 40. Further, a plurality of transverse ribs 42 extending in the transverse direction are formed in a manner continuous with the vertical ribs 40 and the respective adjacent vertical ribs 41 such that they connect between the respective adjacent pairs of the vertical ribs 40 and 41. Furthermore, a plurality of vertical ribs 47 extend in the forward and rearward directions in a manner intersecting the arcuate groove part 52.

The vertical ribs 39, 40, 41, and 47 and the transverse ribs 42 reinforce not only the upper case 31, but also play the role of reinforcing the arcuate groove part 52 since these ribs are directly or indirectly connected to the arcuate groove part 52. More specifically, the transverse ribs 42 are arranged side by side along the length of the arcuate groove part 52, and what is more, some of the vertical ribs 40 and 41 are provided in the vicinity of the apex of the arcuate shape of the arcuate groove part 52, so that the arcuate groove part 52 can sufficiently withstand a stress vertically applied thereto for attachment/detachment of the music stand 10 to/from the keyboard instrument body 30. It is preferred that the upper case 31 is provided with a plurality of transverse ribs 42 and a plurality of vertical ribs 40 and 41, but it may be provided with a single transverse rib 42, a single vertical rib 40, and a single vertical rib 41.

Further, in the vicinity of the arcuate groove part 52, there are formed bosses 43, 44, and 45 for mounting the lower case 8, and transverse ribs 46 are formed in a manner continuous with the respective bosses 45. These elements also play the role of reinforcing the arcuate groove part 52.

Figure 5C:
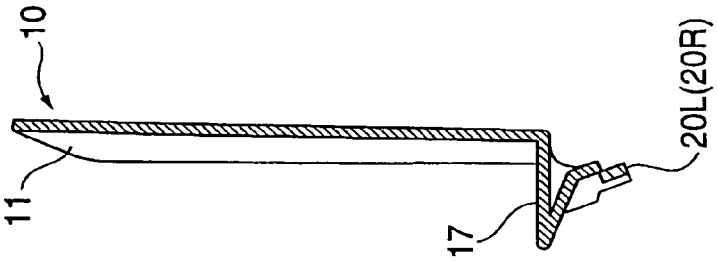
FIG. 5C is a cross-sectional view taken on line B-B of FIG. 5A.
Figure 5A:
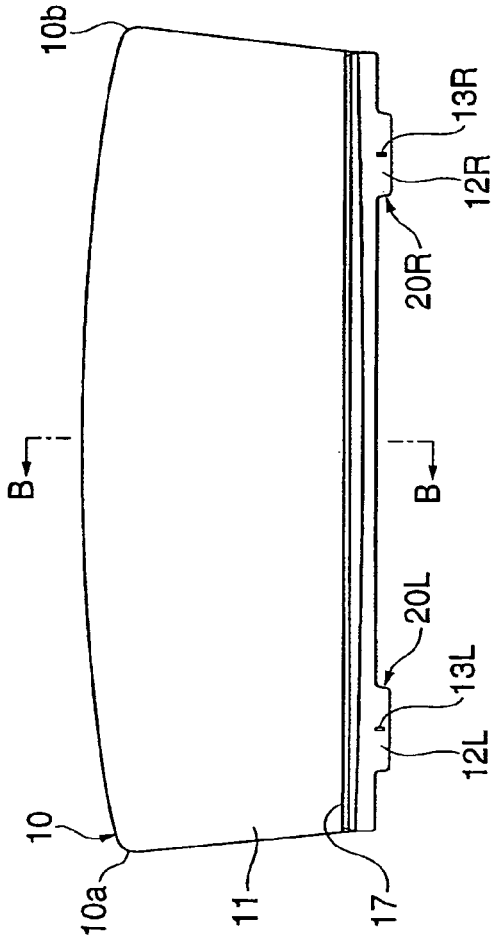
FIG. 5A is a front view of a music stand appearing in FIGS. 1A and 1B.
Figure 5B:
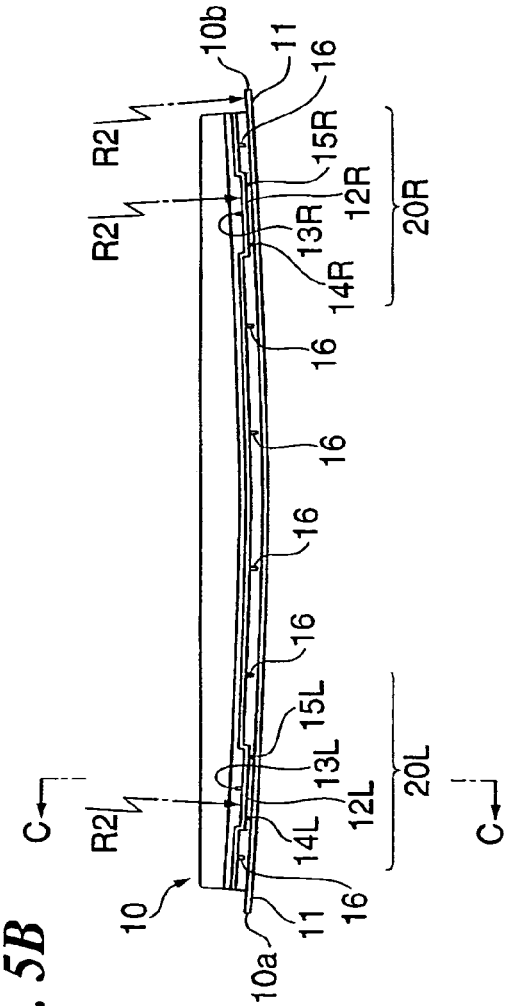
FIG. 5B is a bottom view of the music stand.
Figure 6:
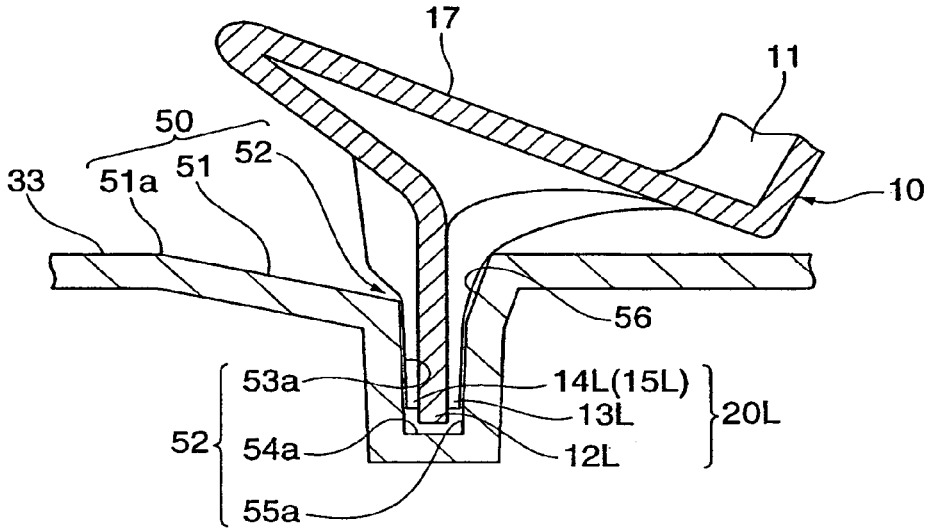
FIG. 6 is a view showing a cross section taken on line C-C of FIG. 5B together with a cross section of a music stand erecting part.

FIG. 5A is a front view of the music stand 10 appearing in FIGS. 1A and 1B, and FIG. 5B is a bottom view of the same. Further, FIG. 5C is a cross-sectional view taken on line B-B of FIG. 5A. FIG. 6 is a view showing a cross section taken on line C-C of FIG. 5B together with a cross section of the music stand erecting part 50.

As shown in FIGS. 5A and 5C, the music stand 10 is comprised of two leg parts 20 (20L and 20R) formed at a bottom thereof at respective locations longitudinally spaced from each other, a music book resting member 17 for holding the lower end of a music book 9, and a music book support 11 for supporting the rear surface of the music book 9. The music stand 10 is a one-piece member formed e.g. of a translucent resin. The leg parts 20L and 20R include respective plate parts 12 (12L and 12R) protruded downward. As shown in FIG. 5B, each of the plate parts 12L and 12R is formed along a gentle curve having a radius R2 with a center located forward of the plate part 12L or 12R, such that they extend in a rearwardly convex manner. Similarly to the plate parts 12L and 12R, the music book support 11 extends curved along a curve having the radius R2.

The radius R2 is equal in value to the radius R1 of the curve along which the arcuate groove part 52 (the front wall 53 and the rear wall 55) extends. Further, the leg parts 20L and 20R are in positional relationship along the curved shape of the arcuate groove part 52 (the front wall 53 and the rear wall 55) such that when one of them fits in the arcuate groove part 52, the other also fits in the same. More specifically, when the leg parts 20L and 20R are positioned on the curved shape of the arcuate groove part 52, the plate parts 12L and 12R of the respective leg parts 20L and 20R are brought into a state curved in the same direction at the same curvature as the arcuate groove part 52.

Each of the plate parts 12 has a contact rib 13 (13L or 13R) formed in a central part thereof in the transverse direction and contact ribs 14 (14L or 14R) and 15 (15L or 15R) formed at respective left and right ends in a manner spaced from each other. The contact rib 13L (13R) is integrally formed with the plate part 12L (12R) on the front surface of the same, and the contact ribs 14R and 15R are integrally formed with the plate part 12L (12R) on the rear surface of the same. Further, below the music book resting member 17, there are formed a plurality of reinforcing vertical ribs 16 at locations other than the locations where the leg parts 20L and 20R are formed (see FIG. 5B).

Next, how the music stand 10 is erected on the music stand erecting part 50 will be described with reference to FIG. 6. Although in FIG. 6, only the leg part 20L of the music stand 10 fitted in the arcuate groove part 52 is shown as a representative of the two leg parts 20, the construction of the leg part 20R and the manner of fitting the same are quite the same as those of the leg part 20L.

As shown in FIG. 6, the leg part 20L is formed in a manner fittable with the arcuate groove part 52. More specifically, the contact rib 13L of the leg part 20L slopes forward along the tapered shapes of the rear surface 53*a* of the front wall 53 of the arcuate groove part 52 as it extends upward and the contact ribs 14L and 15L slope rearward along the front surface 55*a* of the rear wall 55 of the same as they extend upward.

When the leg part 20L is inserted into the arcuate groove part 52, the plate part 12L comes into engagement with the arcuate groove part 52, with the contact ribs 13L, 14L, and 15L fitted in the same, with a gap formed between the same and the bottom surface 54*a* of the arcuate groove part 52. Since the tapered shape of the arcuate groove part 52 corresponds to those of the contact ribs 13L, 14L, and 15L, the music stand 10 is stably supported by the arcuate groove part 52. At this time, the music book support 11 is in a rearwardly tilted position (see FIG. 1B).

To erect the music stand 10 in the music stand erecting part 50, normally, the leg parts 20L and 20R are brought into contact with the panel section 33 from above at a location in front of the arcuate groove part 52 and are slid rearward along the sloping surface part 51. Then, when the leg parts 20L and 20R reach the location of the arcuate groove part 52, they insert themselves into the arcuate groove part 52 by the own weight of the music stand 10 and are fitted therein. Thus, the sloping surface part 51 functions as an engagement guide part for erecting the music stand 10. Further, the music stand 10 can be removed from the arcuate groove part 52 simply by pulling the music stand 10 upward so that the leg parts 20L and 20R are pulled out from the arcuate groove part 52.

Wherever in the transverse direction the plate parts 12L and 12R are fitted in the arcuate groove part 52, they are brought into a state curved in the same direction at the same curvature as the arcuate groove part 52, so that the leg parts 20L and 20R can be engaged with the arcuate groove part 52, in a desired position. Therefore, it is possible to select an erecting location of the music stand 10 as desired insofar as the location is within a range between a location where the leg part 20L is brought into contact with the left end 52*a* (see FIG. 2A) of the arcuate groove part 52 and a location where the leg part 20R is brought into contact with the right end 52*b* of the arcuate groove part 52.

Further, since the arcuate groove part 52 is curved in a rearwardly convex manner, even if the music stand 10 is erected in the vicinity of the left or right end of the arcuate groove part 52, the front surface of the music book support 11 of the music stand 10 faces toward the player, compared with the case where the arcuate groove part 52 extends linearly. Therefore, wherever the music stand 10 is erected in the arcuate groove part 52, a written musical score of the music book 9 can be easily viewed.

As shown in FIGS. 5A and 5B, left and right ends 10*a* and 10*b* of the music stand 10, which also give the respective left and right ends of the music book support 11, are located outward of the left end of the leg part 20L and the right end of the leg part 20R, respectively. Consequently, when the left end of the leg part 20L is in contact with the left end 52*a* of the arcuate groove part 52, the left end 10*a* of the music stand 10 is positioned at a location P1 shown in FIG. 2A, while when the right end of the right part 20R is in contact with the right end 52*b*, the right end 10*b* of the music stand 10 is positioned at a position P2. The locations P1 and P2 correspond to approximately the centers of the respective sounding sections 34 and 35 in the transverse direction, respectively. Therefore, even when the music stand 10 is erected in the leftmost or rightmost position in the transverse direction where the music stand 10 can be erected, the approximate half of the sounding section 34 or 35, as viewed from the front, is not hidden behind the music book support 11, so that sound can be output forward. If the sounding section 34 or 35 were completely covered by the music book support 11, transmission of sound would be impaired particularly in the high-frequency range. In the present embodiment, however, since the music stand 10 is configured to be positioned as described above, it is possible to limit degradation of the sounding function of the sounding section 34 (35) to tolerance to thereby ensure that sound is output clearly without being muffled.

Although a keyboard instrument body 30 is generally provided with a single music stand 10, the user can additionally obtain a music stand 10 of the same construction afterwards and use the two music stands 10.

Figure 7A:
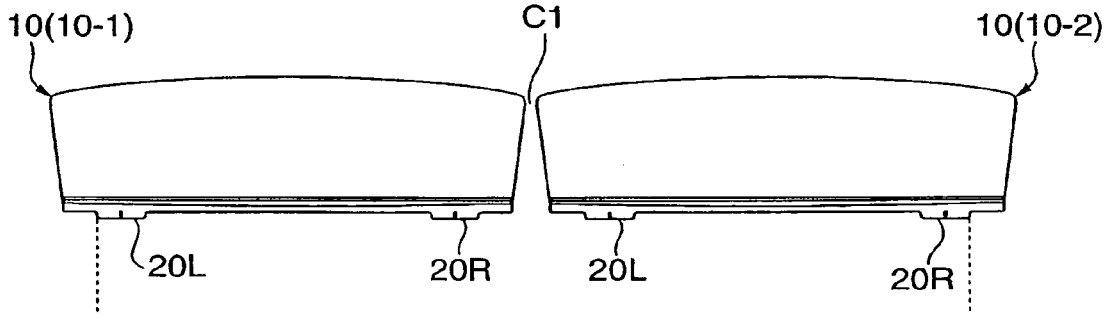
FIG. 7A is a front view of two music stands, which shows the dimensional relationship between the two music stands and the music stand erecting part.
Figure 7B:
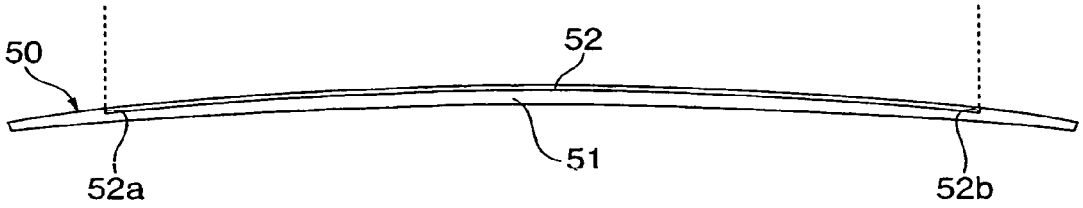
FIG. 7B is a plan view of the music stand erecting part, which shows the dimensional relationship between the two music stands and the music stand erecting part.

FIG. 7A is a front view of two music stands, which shows the dimensional relationship between the two music stands and the music stand erecting part. FIG. 7B is a plan view of the music stand erecting part, which shows the dimensional relationship between the two music stands and the music stand erecting part As shown in FIGS. 7A and 7B, the two music stands 10 are distinguished from each other by designating one as a first music stand 10-1 and the other as a second music stand 10-2. The total width of the music stands 10 in the transverse direction is shorter than the entire length of the music stand erecting part 50. When the left end of the leg part 20L of the first music stand 10-1 is held in contact with the left end 52*a* of the arcuate groove part 52 and the right end of the leg part 20R of the second music stand 10-2 is held in contact with the right end 52*b* of the arcuate groove part 52, there is formed a gap C1 between the two music stands 10. Therefore, the two music stands 10 can be simultaneously arranged side by side in the music stand erecting part 50 in a manner adjacent to each other in the transverse direction. This makes it possible to place a horizontally long music book prepared for a long piece of music, in an open state so as to save the user the trouble of turning pages of a music book or reduce the number of times of page turning operation.

There are cases where a thin plate, a bundle of thick sheets, or the like is used as a temporary music stand in place of a music stand included as an attachment, so as to place a horizontally long music book of the above-mentioned kind in the open state. Also in the present embodiment, it can be assumed that the user uses such a temporary music stand in place of or in addition to the music stand 10. The temporary music stand can provide support, for example, for a part of a music book which one music stand 10 cannot support.

Figure 8A:
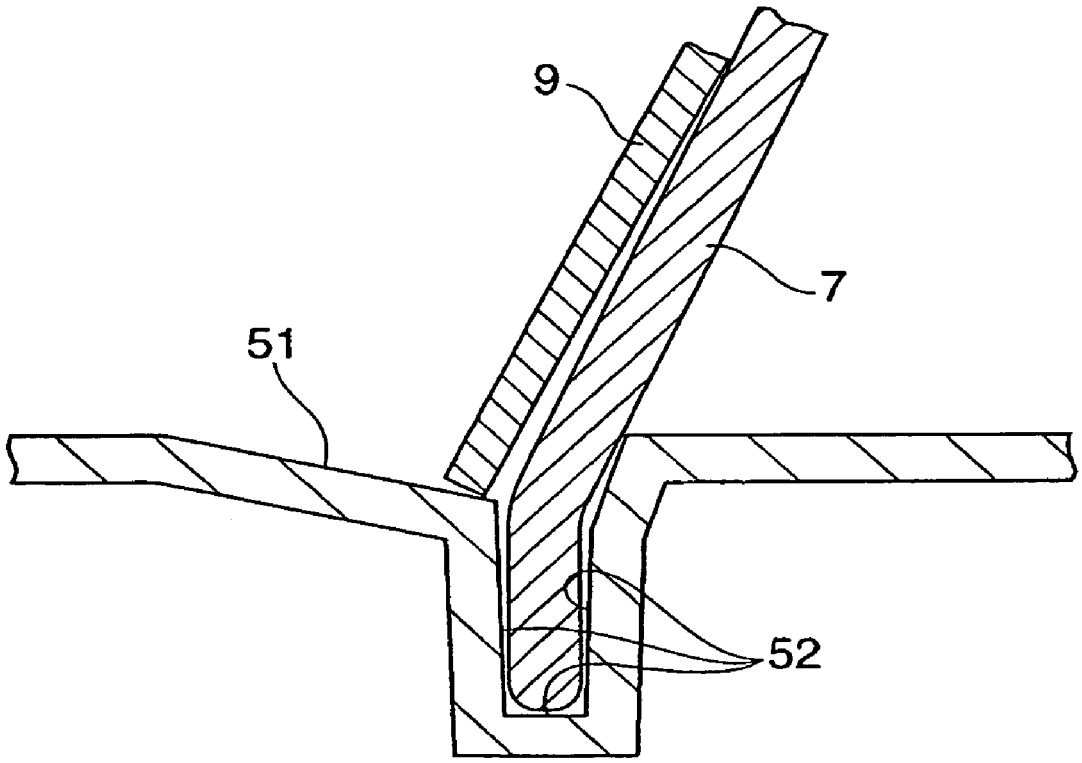
FIG. 8A is a cross-sectional view of a music book placed on a temporary music stand.
Figure 8B:
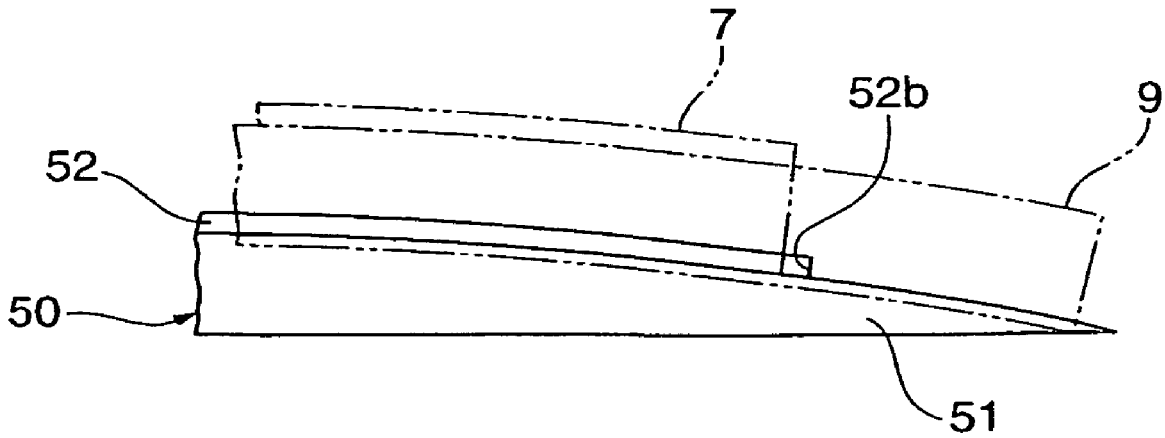
FIG. 8B is a plan view of a right end of the music stand erecting part, which is useful in explaining the positional relationship between the music stand erecting part and the temporary music stand.

FIG. 8A is a cross-sectional view of the music book placed on a temporary music stand. FIG. 8B is a plan view of the right end of the music stand erecting part, which is useful in explaining the positional relationship between the music stand erecting part and the temporary music stand.

As shown in FIG. 8A, the temporary music stand 7 has a lower end thereof fitted in the arcuate groove part 52, and a part of the temporary music stand 7 extending upward of the arcuate groove part 52 is tilted rearward so that a written musical score of the music book can be easily viewed. This temporary music stand 7 does not have a part corresponding to the music book resting member 17 of the music stand 10, and hence the lower end of the music book 9 is held in direct contact with the sloping surface part 51. In this case, the sloping surface part 51 plays the role of supporting the lower end of the music book 9 similarly to the music book resting member 17. Since the sloping surface part 51 slopes down rearward, the lower end of the music book 9 supported by the temporary music stand 7 is made difficult to slide forward.

Further, as shown in FIG. 8B, when held in contact with the right end 52*b* of the arcuate groove part 52, the temporary music stand 7 is in the rightmost position. The sloping surface part 51 extends to a location rightward of the right end 52*b* as described hereinabove. Therefore, even when the temporary music stand 7 is erected in the rightmost position, the music book 9 can be placed such that it extends to a location beyond the right end 52*b*, with the slip-preventive effect maintained, provided that the sloping surface 51 exists at the location. This is advantageous in using a horizontally long music book or sheet.

According to the present embodiment, the arcuate groove part 52 and the leg parts 20 are formed in a manner fittable with each other, and the arcuate groove part 52 is curved in a rearwardly convex manner. At the same time, the two leg parts 20 of the music stand 10 can be simultaneously fitted at respective desired locations in the arcuate groove part 52. Therefore, it is possible to erect the music stand 10 in a desired position in the transverse direction on the panel section 33. Further, since the arcuate groove part 52 is curved to be convex rearward, even when the music stand 10 is erected in the vicinity of the left or right end of the arcuate groove part 52, the music book 9 faces toward the player, so that it is possible to ensure easiness of viewing a written musical score of the music book 9. Nevertheless, in front of the music stand 10 erected in the center of the arcuate groove part 52 in the transverse direction, the user never feels the sense of being oppressed.

Further, even when the music stand 10 is erected in the leftmost or rightmost position where the music stand 10 can be erected, only the approximate half of the sounding section 34 or 35, as viewed from the front, is hidden by the music stand 10, so that degradation of the sounding function of the sounding section 34 (35) for outputting sound forward can be limited to tolerance. It should be noted that the leg parts 20 of the music stand 10 and the left and right ends 52*a* and 52*b* of the arcuate groove part 52 have only to be positioned such that the locations P1 and P2 (see FIG. 2A) do not substantially obstruct the sounding sections 34 and 35, respectively. In this case, it is preferred that the locations P1 and P2 should be set such that at least more than one third of the sounding sections 34 and 35 laterally extend leftward and rightward of the music stand 10, respectively.

Further, according to the present embodiment, since the sloping surface part 51 formed in a manner continuous with the arcuate groove part 52 slopes down rearward, the sloping surface part 51 plays the role of an engagement guide for erecting the music stand 10 in the music stand erecting part 50, which facilitates work for erecting the music stand 10. Furthermore, when the temporary music stand 7 is used for supporting the music book 9, the sloping surface part 51 not only receives the music book 9, but also functions as a slip stopper. Thus, despite its simple construction, the sloping surface part 51 has a wide range of uses.

Further, since the arcuate groove part 52 is formed into a bottomed groove having a generally U shape in cross section, and continuous with the sloping surface part 51 as an inclined surface, the music stand erecting part 50 has a large cross-sectional secondary moment, which ensures high rigidity and stable erection of the music stand 10. It should be noted that the aforementioned transverse ribs 42 and vertical ribs 40 and 41 also contribute to an increase in the cross-sectional secondary moment of the upper case 31 (or the panel section 33).

Further, when two music stands 10 are used, the music stands 10 can be simultaneously arranged side by side in a manner adjacent to each other in the transverse direction, which makes it possible to place a horizontally long music book or sheet easily in the open state to thereby contribute to an increase in the range of uses.

It should be noted that in order to simultaneously arrange a plurality of music stands 10 side by side, each of the music stands 10 and the music stand erecting part 50 have only to be configured such that the total of the transverse widths of the respective music stands 10 is equal to or smaller than that of the musical keyboard instrument 100, and the left and right ends of the respective music stands 10 to be erected in the leftmost and rightmost positions, respectively, are positioned inward of the respective opposite ends of the musical keyboard instrument 100. Therefore, the number of music stands 10 that can be erected simultaneously is not limited to two. Three or more music stands 10 may be erected, and the music stands 10 may be different in size from each other.

In the present embodiment, each of the sounding sections 34 and 35 may be divided into a high-frequency sounding range and a low/mid-frequency sounding range, such that the outer parts of the respective sounding sections 34 and 35, i.e. the left half of the sounding section 34 and the right half of the sounding section 35, basically function as high-frequency sounding ranges. This makes it possible to prevent high-frequency sounding, which is more likely to have transmission thereof hindered by an obstacle than low/mid-frequency sounding, from being easily blocked by the music stands 10.

In the present embodiment, the right one 35 of the sounding sections 34 and 35 may be configured to basically play the role of high-frequency sounding by incorporating a tweeter therein. In this case, it is preferred that the right end 52*b* is positioned more inwardly in the transverse direction than the left end 52*a*, or that the right end of the right one 20R of the leg parts 20L and 20R is positioned more outwardly in the transverse direction than the left end of the leg part 20L. This makes an area of the sounding section 35 hidden by the music stand 10 smaller than that of the sounding section 34, and therefore it is possible to prevent high-frequency sounding from being easily blocked by the music stands 10.

It should be noted that from the viewpoint of improving the function of the sounding section 34 (35) for sounding forward, the music book support 11 of the music stand 10 may be formed with numerous small through holes.

Next, a description will be given of variations of the musical keyboard instrument of the present embodiment.

Although in the above described embodiment, the sloping surface part 51 functions as an engagement guide for the music stand 10, the engagement guide is not necessarily required to be configured like the sloping surface part 51.

Figure 9A:
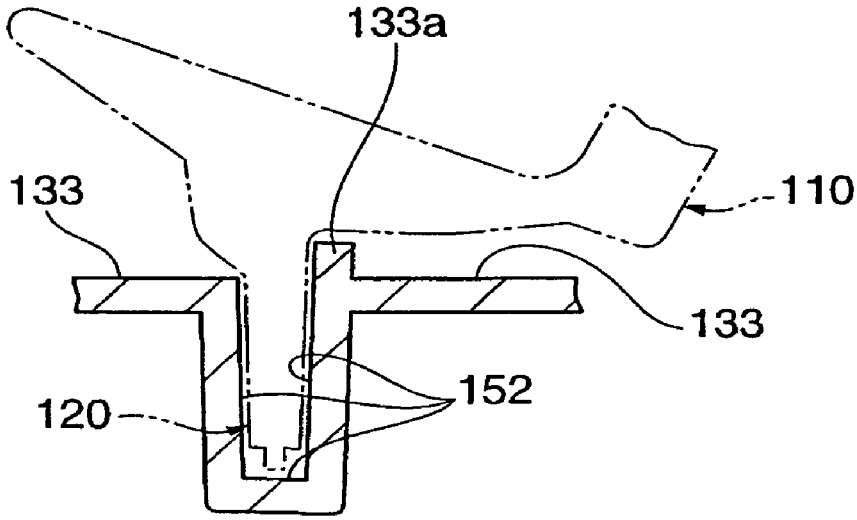
FIG. 9A is a schematic view of a music stand erecting part according to a first variation of the present embodiment having a music stand erected therein.

FIG. 9A is a schematic view of a music stand erecting part according to a first variation of the present embodiment having a music stand erected therein. For example, as shown in FIG. 9A, the front part of an arcuate groove part 152 corresponding to the arcuate groove part 52 is not formed as a sloping surface part, and in a rear part of the arcuate groove part 152, there is formed a stopper part 133*a* protruded upward from a panel section 133 corresponding to the panel section 33.

With this configuration, when a music stand 110 corresponding to the music stand 10 is slid rearward on the panel section 133 for engagement with the arcuate groove part 152, an upper part of a leg part 120 of the music stand 110 comes into abutment with the stopper part 133*a*. Then, the leg part 120 inserts itself into the arcuate groove part 152 by the own weight of the music stand 110 and is fitted therein.

It should be noted that both the stopper part 133*a* in this first variation and the sloping surface part 51 may be provided such that they cooperate with each other to function as an engagement guide.

In the above described embodiment, the panel section is formed with the arcuate groove part 52 as a grooved or recessed engagement part (hereinafter referred to as "the panel-side engagement part"), and the music stand is formed with the plate parts 12 of the respective leg parts 20 and the contact ribs 13, 14, and 15 as protruded engagement parts (see FIG. 5B) (hereinafter referred to as "the music stand-side engagement part") so that the music stand 10 can be erected by fitting the two engagement parts together. However, the concave-convex relationship between the two engagement parts may be reversed. More specifically, a grooved music stand-side engagement part may be engaged with a protruded panel-side engagement part.

Figure 9B:
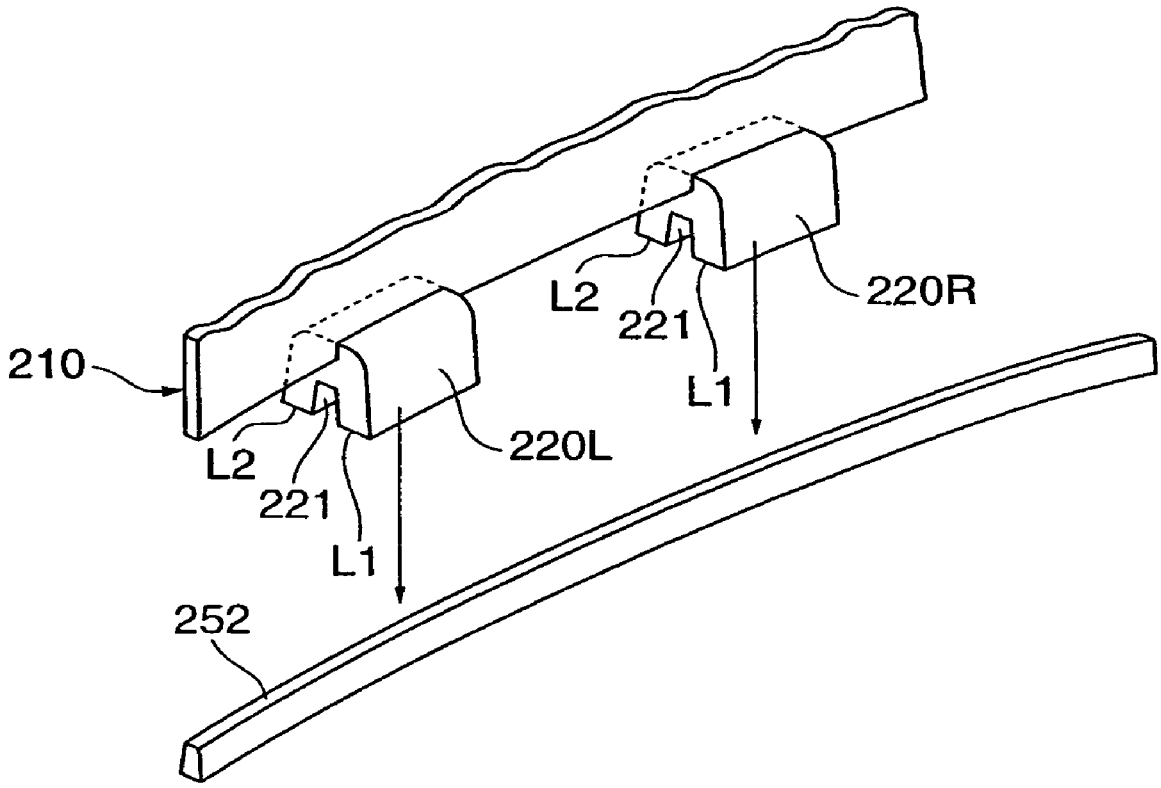
FIG. 9B is a perspective view of a panel-side engagement part and a music stand-side engagement part according to a second variation of the present embodiment.

FIG. 9B is a perspective view of a panel-side engagement part and a music stand-side engagement part according to a second variation of the present embodiment For example, as shown in FIG. 9B, the panel section 33 is formed with an arcuate ridge part 252 in place of the arcuate groove part 52.

On the other hand, a music stand 210 corresponding to the music stand 10 has leg parts 220 (220L and 220R) each of which is formed with a U-shaped groove 221 open downward and having a shape corresponding to that of the arcuate ridge part 252. The curved shape (radius of curvature) of the arcuate ridge part 252 is the same as that of the arcuate groove part 52, and the curved shape (radius of curvature) of the U-shaped groove 221 is the same as that of the plate part 12 of the leg part 20 of the music stand 10.

With this configuration, the U-shaped grooves 221 can be fitted in a desired position in the transverse direction on the arcuate ridge part 252, so that as in the example shown in FIG. 1A to 8B, the music stand 210 can be erected in a desired position in the transverse direction. It should be noted that when the panel section 33 is formed with the arcuate ridge part 252, even if the musical keyboard instrument is placed on the floor or the like upside down for maintenance, the switches 36 to 38 and the sounding sections 34 and 35 can be protected from being scratched. In short, the arcuate ridge part 252 plays the role of a protector for essential functional components of the musical keyboard instrument.

In the second variation, the U-shaped groove 221 of the leg part 220 may be configured to have a front wall L1 extending downward to a lower location than a rear wall L2, so as to implement the engagement guide function. In this case, the front wall plays the same role as the stopper 133*a* (see FIG. 9A) in the first variation and functions as an engagement guide by coming into abutment with the arcuate ridge part 252.

Alternatively, the U-shaped groove 221 may be configured to have the rear wall L2 extending downward to a lower location than the front wall L1. This makes it possible not only to easily fit the music stand 210 on the arcuate ridge part 252, but also to prevent the music stand 210 from easily falling rearward from the musical keyboard instrument.

Figure 10:
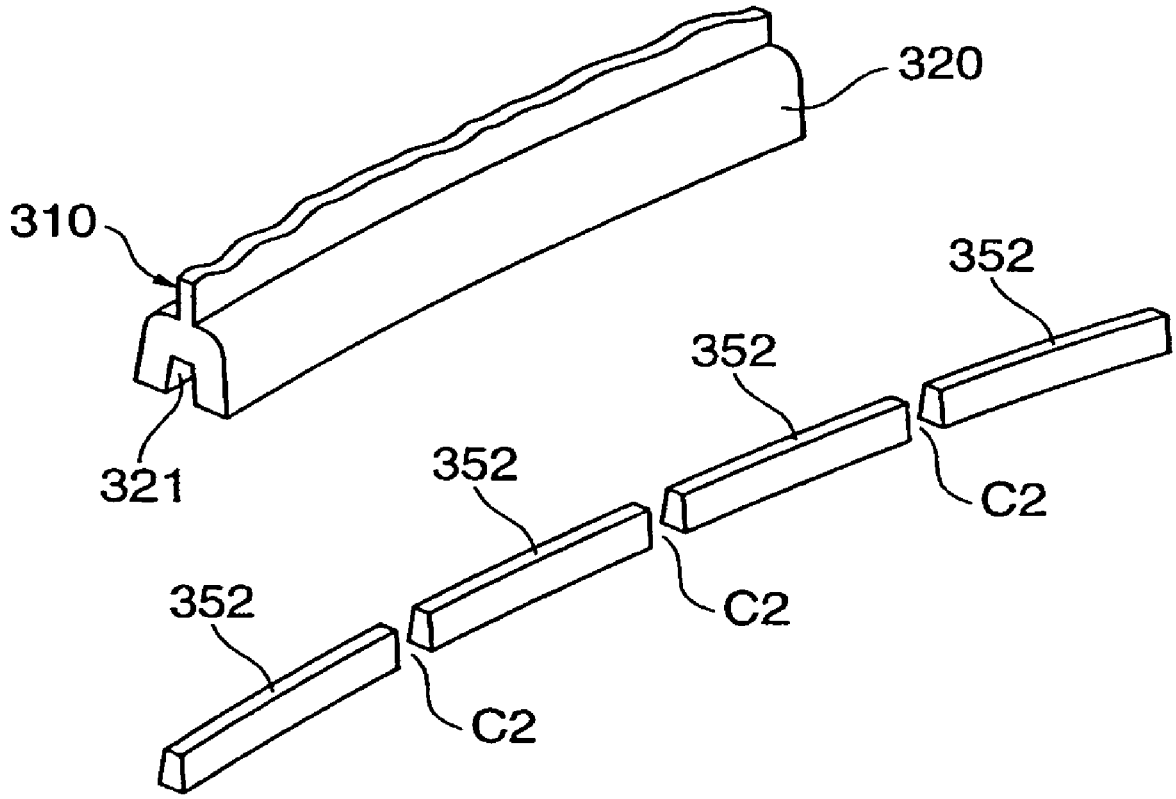
FIG. 10 is a perspective view of a panel-side engagement part and a music stand-side engagement part according to a third variation of the present embodiment.

FIG. 10 is a perspective view of a panel-side engagement part and a music stand-side engagement part according to a third variation of the present embodiment. For example, as shown in FIG. 10, a plurality of arcuate ridge parts 352 formed by cutting the arcuate ridge part 252 in the second variation (see FIG. 9B) are arranged in a row in the transverse direction. On the other hand, a music stand 310 is formed with a leg part 320 formed by combining the leg parts 220 of the music stand 210 into a single structure. Consequently, the leg part 320 is formed with a single continuous U-shaped groove 321. A gap C2 between the arcuate ridge parts 352 is set to a sufficiently shorter length than the length of the U-shaped groove 321.

With this configuration, since the U-shaped groove 321 can be fitted in a desired location on the arcuate ridge parts 352 in the transverse direction, it is possible to erect the music stand 310 in a desired position in the transverse direction as in the second variation.

As shown in the second and third variations, by way of example, it suffices that the music stand-side engagement part and the panel-side engagement part are formed into shapes fittable with each other, i.e. one has a protruded shape and the other a grooved shape, and at least one of them is formed continuously. In this case, the continuously formed one of the music stand-side engagement part and the panel-side engagement part is not required to be completely continuous over its entire length, but it may be formed by serially arranging a plurality of protrusions or grooves such that it can substantially function as a continuous part. For example, although in the second variation (see FIG. 9B), the arcuate ridge part 252 is formed into a shape continuous over its entire length, the third variation may be applied to the arcuate ridge part 252. In this case, since the arcuate ridge part 252 is provided with gaps smaller in transverse length than the U-shaped groove 221, the arcuate ridge part 252 is actually formed by arranging a plurality of ridges in a row.

In the above described embodiment (FIGS. 1A to 8B), when the leg parts 20 of the music stand 10 are fitted in the arcuate groove part 52, the contact ribs 13, 14, and 15 (see FIG. 5B) come into vertical line contact with the arcuate groove part 52, so that each of the leg parts 20 is substantially supported at three points by the contact ribs 13, 14, and 15. Therefore, from the viewpoint of allowing a music stand to be erected in a desired position in the transverse direction on the panel section and ensuring easiness of viewing the music stand even when it is erected in the vicinity of the left and right end of the panel section, it is not essential that the plate part 12 of each of the leg parts 20 is curved at the same curvature as the arcuate groove part 52.

From this viewpoint, only one of the music stand-side engagement part and the panel-side engagement part may be formed as a curved continuous ridge or groove. In this case, the other of the music stand-side engagement part and the panel-side engagement part can be configured such that it has a plurality of portions each formed into a shape for sandwiching the corresponding ridge or a shape for being fitted in the corresponding groove, for face contact or vertical line contact with the corresponding ridge or groove.

What is claimed is:

1. A musical keyboard instrument comprising:

a keyboard section that includes a plurality of keys arranged in a front part thereof;

a panel section that is provided at a location rearward of said keyboard section; and a panel-side engagement part that is formed on said panel section for engagement with a music stand-side engagement part of a music stand that supports a music score and has a leg part formed with the music stand-side engagement part, wherein said panel-side engagement part is formed such that the music stand-side engagement part of the music stand can be engaged with said panel-side engagement part in a desired position in a transverse direction, and wherein said panel-side engagement part is curved in a rearwardly convex manner, and the music stand-side engagement part is engaged with said panel-side engagement part, whereby the music stand can be erected in a desired position in the transverse direction on said panel section.

2. A musical keyboard instrument as claimed in claim 1, wherein the music stand-side engagement part of the music stand is protruded, and said panel-side engagement part on said panel section has a shape of a bottomed groove.

3. A musical keyboard instrument as claimed in claim 1, wherein the music stand-side engagement part of the music stand has a shape of a groove, and said panel-side engagement part on said panel section is protruded.

4. A musical keyboard instrument as claimed in claim 1, comprising left and right sounding sections that are disposed in opposite left and right ends of said panel section, respectively, for sounding musical tones at least forward, and wherein said panel-side engagement part causes a left or right end of the music stand to be positioned at a location where the left or right end of the music stand does not substantially obstruct the left or right sounding section when the music stand is erected in a leftmost or rightmost position on said panel section within a range where the music stand can be erected.

5. A musical keyboard instrument as claimed in claim 1, wherein the music stand-side engagement part of the music stand has a protruded shape, and said panel-side engagement part on said panel section has a shape of a groove, and wherein an engagement guide part guides the music stand-side engagement part into engagement with said panel-side engagement part when the music stand is erected on said panel section.

6. A musical keyboard instrument as claimed in claim 1, wherein the music stand-side engagement part of the music stand has a protruded shape, and said panel-side engagement part on said panel section has a shape of a groove, and wherein a sloping part is provided at a location forward of said panel-side engagement part such that said sloping part slopes down rearward to be continuous with said panel-side engagement part.

7. A musical keyboard instrument comprising:

a keyboard section that includes a plurality of keys arranged in a front part thereof;

a panel section that is provided at a location rearward of said keyboard section, said panel section having a panel-side engagement part formed thereon;

a music stand that supports a music score, said music stand having a leg part and a music stand-side engagement part that is formed on the leg part so as to be engageable with the panel-side engagement part in a desired position in a traverse direction on said panel section, wherein at least one of said panel-side engagement part and said music stand-side engagement part is curved in a rearwardly convex manner, and said music stand-side engagement part is engaged with said panel-side engagement part, whereby said music stand can be erected in a desired position in the transverse direction on said panel section.

8. A musical keyboard instrument as claimed in claim 7, wherein said music stand-side engagement part of said music stand has a protruded shape, and said panel-side engagement part on said panel section has a shape of a bottomed groove.

9. A musical keyboard instrument as claimed in claim 7, wherein said music stand-side engagement part of said music stand has a shape of a groove, and said panel-side engagement part on said panel section has a protruded shape.

10. A musical keyboard instrument as claimed in claim 7, wherein a plurality of said music stands are provided, a total of transverse widths thereof being equal to or smaller than a transverse width of the musical keyboard instrument, and said music stands can be simultaneously arranged side by side on said panel section in a manner transversely adjacent to each other.

* * * * *